United States Patent [19]

Samuelsen et al.

[11] 4,084,995

[45] Apr. 18, 1978

[54] PREPARATION OF A CAP SENSITIVE PARTICULATE EXPLOSIVE COMPOSITION COMPRISING CALCIUM NITRATE

[75] Inventors: Eirik Samuelsen, Lierbyen; Oddvar Alm, Drammen, both of Norway

[73] Assignee: Dyno Industrier A.S., Oslo, Norway

[21] Appl. No.: 725,127

[22] Filed: Sep. 20, 1976

[30] Foreign Application Priority Data

| | | |
|---|---|---|
| Sep. 19, 1975 | Norway | 753212 |
| Jun. 14, 1976 | Norway | 762043 |
| Aug. 16, 1976 | Norway | 762824 |

[51] Int. Cl.[2] ..... C06B 31/42

[52] U.S. Cl. ..... 149/56; 149/46; 149/61; 149/69; 149/105

[58] Field of Search ..... 149/41, 56, 46, 61, 149/69, 105

[56] References Cited

U.S. PATENT DOCUMENTS 3,660,182 5/1972 Cook et al. ..... 149/61 X

*Primary Examiner*—Stephen J. Lechert, Jr.

*Attorney, Agent, or Firm*—Wenderoth, Lind & Ponack

[57] ABSTRACT

In preparing an explosive composition whose oxidizing components are a mixture of ammonium and calcium nitrate, the nitrate components are heated to temperatures where anhydrous double salts are formed together with some liquid phase. By subsequent cooling of the mixture under sustained mechanical agitation and the addition of a liquid fuel, a dry, free-flowing, cap sensitive particulate explosive composition is formed.

15 Claims, 6 Drawing Figures

PREPARATION OF A CAP SENSITIVE PARTICULATE EXPLOSIVE COMPOSITION COMPRISING CALCIUM NITRATE

BACKGROUND OF THE INVENTION

This invention relates to particulate explosive compositions in which ammonium nitrate and calcium nitrate are used as oxygen supplying components. More specifically, it relates to explosives in which an increased sensitivity is caused by a certain heat treatment of the nitrate components. Thus, the evoked cap sensitivity and the small critical diameter proper to the explosives is mainly dependent on the physical state in which the treatment leaves the mixture, and practically independent of its chemical composition.

DESCRIPTION OF THE PRIOR ART

In general, particulate explosive compositions, or powder explosives, comprise considerable amounts of ammonium nitrate (in the following called AN). In addition, other nitrates, preferably of sodium and calcium (the latter called CN in the following) are proposed and used as an oxygen supplier. The purpose of adding these (earth-) alkaline metal nitrates has mainly been their higher oxygen content to allow a higher content in the explosive of the oxygen consuming components.

The kind and amount of these oxygen consuming components has been considered decisive for a number of the explosive's properties, in particular those relating to sensitivity. Sensitivity parameters comprise minimum initiating charge, or minimum booster, and critical diameter, among others.

In the range of rather sensitive powder explosives, nitric acid esters of glycerine and ethylene glycol, in the following called NG, has been used as a component to ensure cap sensitivity and critical diameters below one inch. The use of NG involves, however, certain problems as to safety, and to certain physiological effects as well, during production and use of the explosive. In the range of the least sensitive particulate explosive mixtures, the mixture of AN and fuel oils, so called ANFO, is found, to be practically free of the ugly properties mentioned, but the minimum booster for their initiation as well as their critical diameter are rather large.

Among other oxygen consuming components used in powder explosives are found nitrated aromatic hydrocarbons, preferably di- and tri-nitro-toluenes. The sensitivity of powder explosives based on their use has not, in general, been on the level obtained by the use of NG. Particulate oxygen components, or fuels, such as wood flour, sulphur, bitumenous matter, silicon and aluminium, have showed little if any effect upon the sensitivity of particulate explosive compositions.

Beside the kind and amount of the oxygen consuming components, the only known precaution to increase the sensitivity seems to be a diminution of the particle size of the nitrates. Highly comminuted AN will provide cap sensitivity in ANFO and cause its detonation to propagate in small boreholes also. These effects have been, however, difficult to reproduce, and have been of little or no practical value. In addition, finegrain AN is, in general, difficult to handle due to a pronounced caking tendency.

It has now been found that certain mixtures of AN and CN, having been subject to a certain heat treatment, impart cap sensitivity to powder explosives made thereof. The sensitivity thus induced equals or exceeds that caused by finely grinding the nitrates, and is comparable to what is achieved by the use of NG.

SUMMARY OF THE INVENTION

It is therefore an object of the present invention to provide a method for the preparation of cap sensitive particulate explosive compositions without the use of NG or other highly sensitive components. It is further an object of the invention to achieve this goal without highly comminuting the nitrate components, and to produce an explosive in the form of a free-flowing particulate matter. Finally, an object is also, as will be apparent below, to make possible the preparation of the explosive in comparatively small, continuously operated and remote controlled equipment, with the gain in safety thus involved.

The improved method consists essentially in forming one or more of the double salts of AN and CN in which the mole ratio of these components is (in the order mentioned) either 1 to 1 or 2 to 1. Mixtures of the said double salts with additional AN are in principle the oxygen supplying components of the explosive composition in question. The double salts mentioned are formed by heating together a mixture of AN with CN, in the presence of certain quantities of water, to a temperature of at least 35° C. The CN to be used in the process may be anhydrous or it may contain certain amounts of water of crystallisation.

Preferably, however, a commercial grade of CN is used in which minor quantities of AN is also present, provided it has a composition not far from that of the compond 5 $Ca(NO_3)_2.NH_4NO_3.10\ H_2O$, as further mentioned below.

Explosive mixtures comprising AN, CN and water in combination with some sorts of fuel, within mixing ratios preferred in this invention, is not per se unknown. What is described in the patent litterature and elsewhere as explosive agents of similar composition is, however, either what is called "melt explosives", or what is commonly known as slurried blasting agents. What these explosives have in common, as opposed to the particulate mixture of the present invention, is primarily their physical appearance, and the way in which they are used, i.e. by pouring or pumping it in a more or less warm condition into boreholes or preformed cartridges. Secondly, and of greater importance, they differ from the particulate mixture of the present invention in their pronounced lower sensitivity, evidenced by the recommendation of boosters of several hundred grams for their initiation and their reported critical diameters of about 4 inches.

One essential feature of the present invention of producing a cap sensitive particulate explosive mixture is the cooling under sustained mechanical movement of the mixture of AN and CN which, as mentioned above, has been heated to at least 35° C.

During the heating period, the component nitrate particles will react to form some quantities of liquid, which at least make them stick together and eventually can make them completely disappear, as further described below. During the subsequent cooling period, before the completion of which the oxygen consuming components are added, the sustained mechanical movement converts the moist or cloggy matter into a free-flowing and apparently dry particulate matter.

The particle size of the explosive mixture thus produced, is less dependent on the particle size of the nitrate components before the treatment, it is more dependent on the conditions during the cooling period.

One condition for achieving an explosive mixture of increased sensitivity by the application of such a heating procedure to the nitrate components is found to be that the oxygen consuming components of the explosive comprise one fuel which is at least partly liquid at the temperature to which the nitrates are heated, i.e. 35° C or higher.

Figure 1:
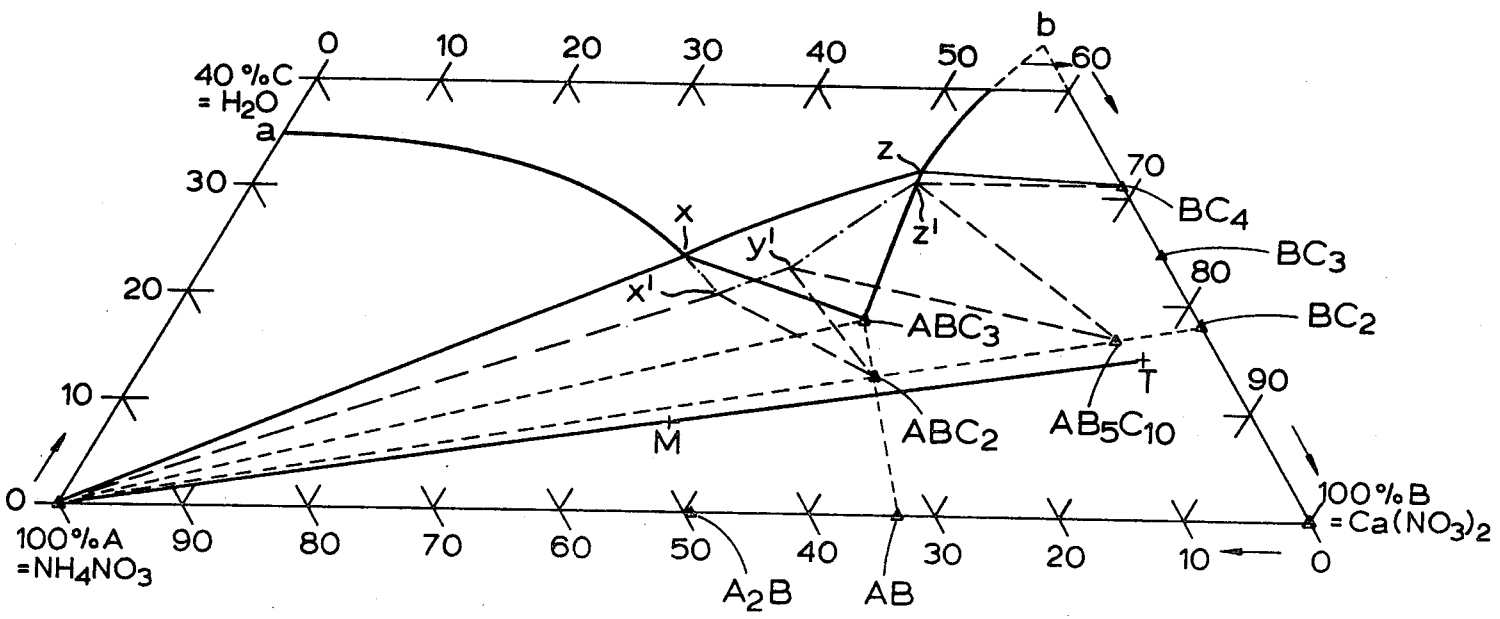
FIGS. 1–5 represent diagram for the system ammonium nitrate, calcium nitrate and water for water contents up to 40%. In each of FIGS. 1–5, solutions which can exist in equilibrium with the crystalline compounds are illustrated by liquidus lines at 20° C, 30° C, 40° C, 50° C and 70° C, respectively.
Figure 2:
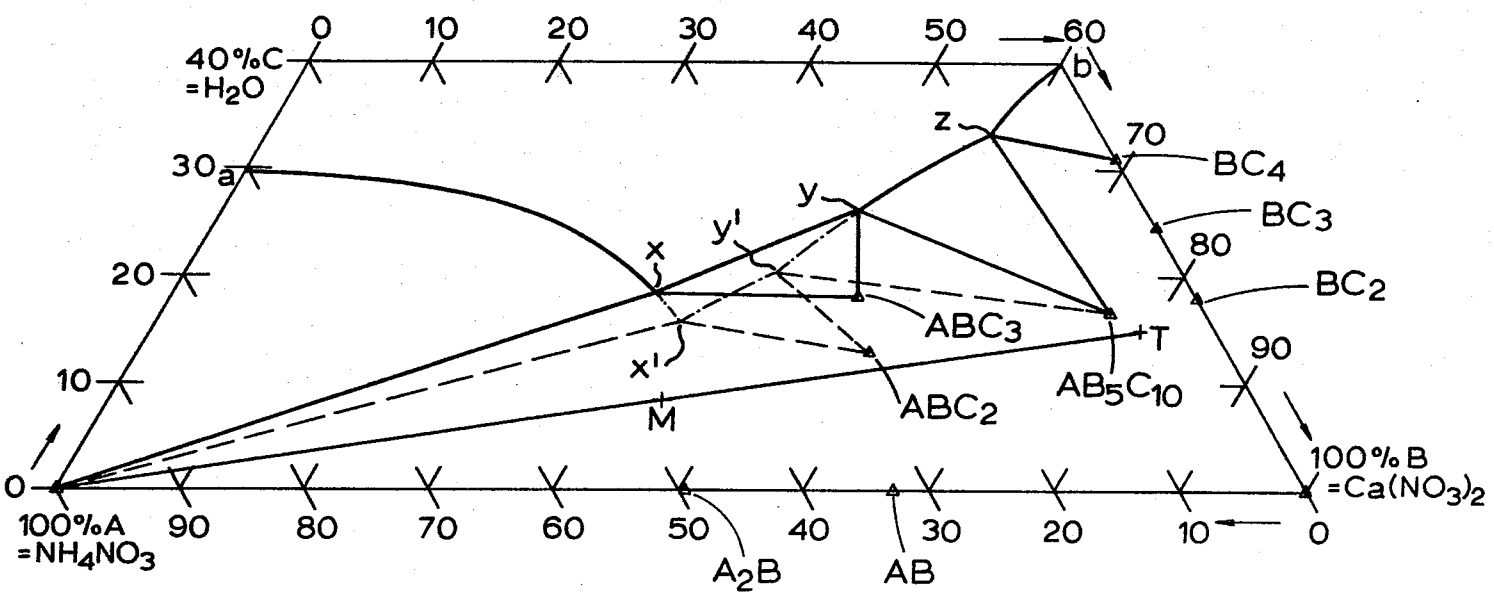
Figure 3:
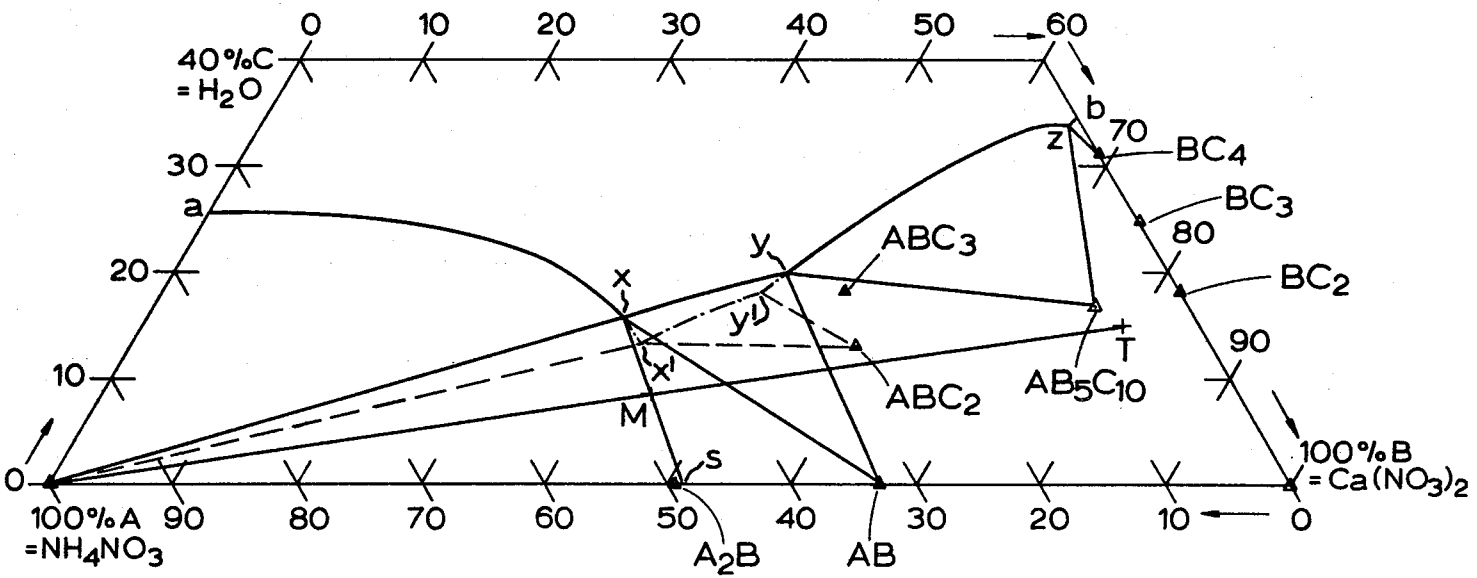
Figure 4:
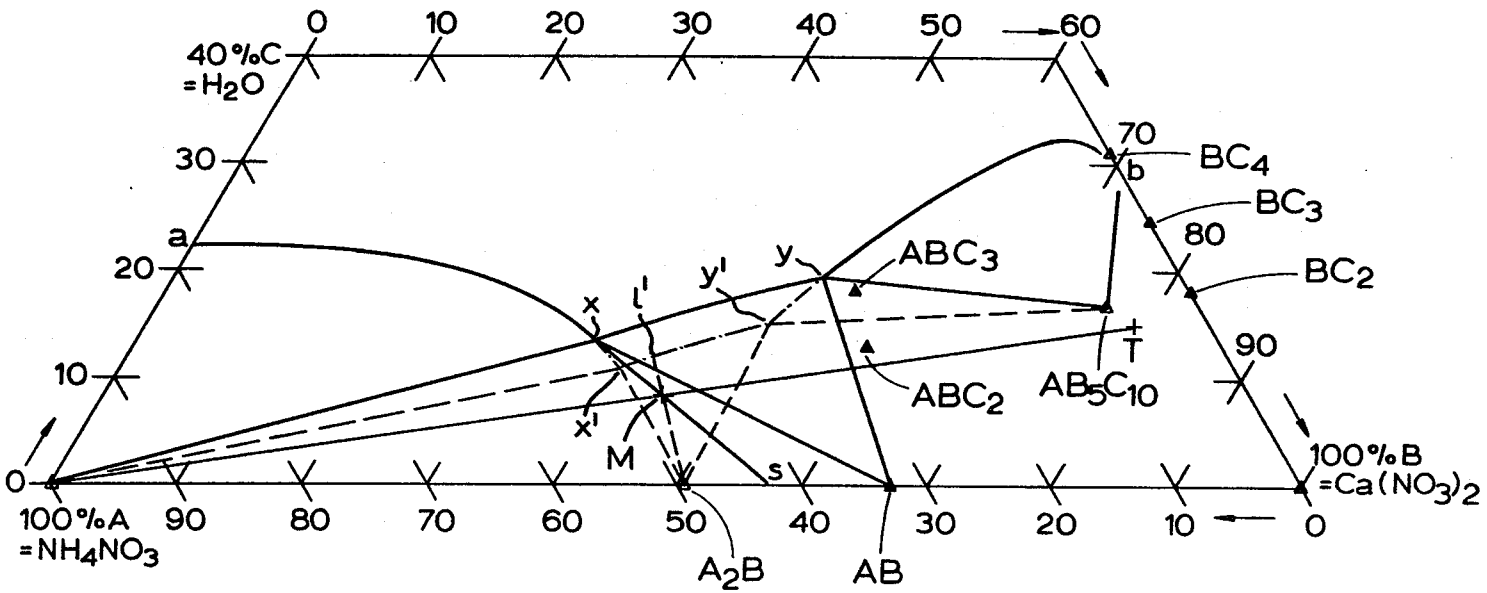
Figure 5:
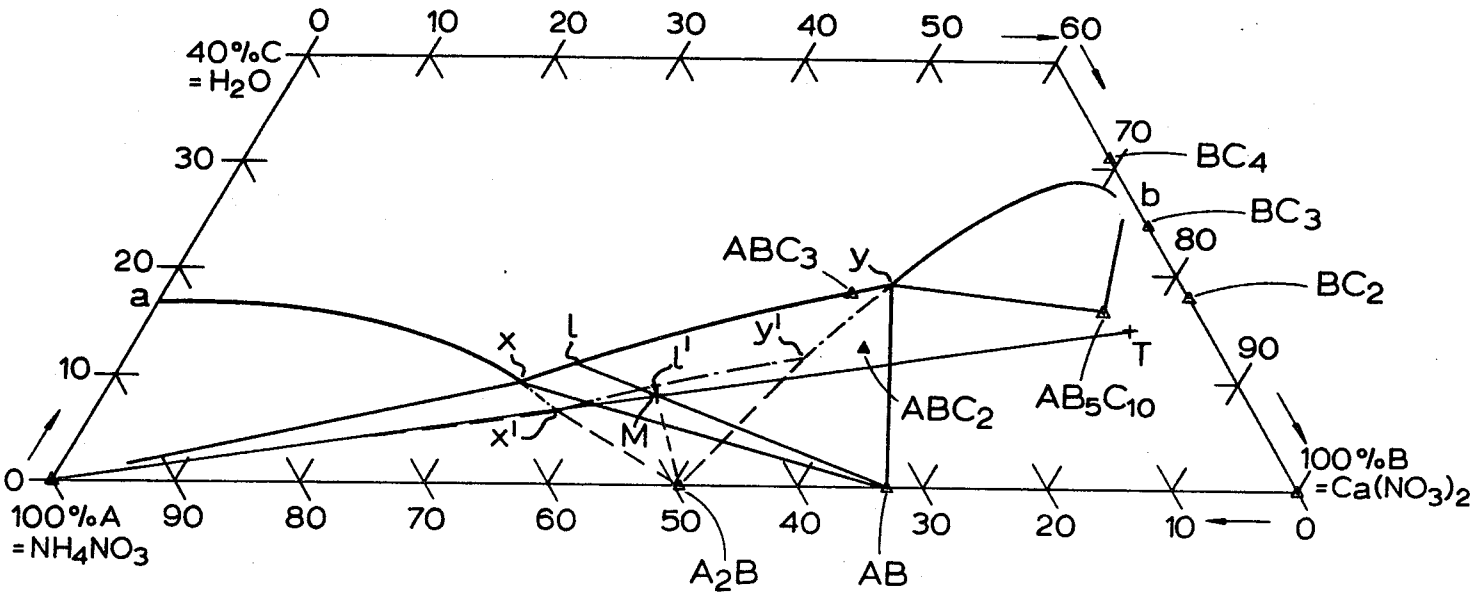
Figure 6:
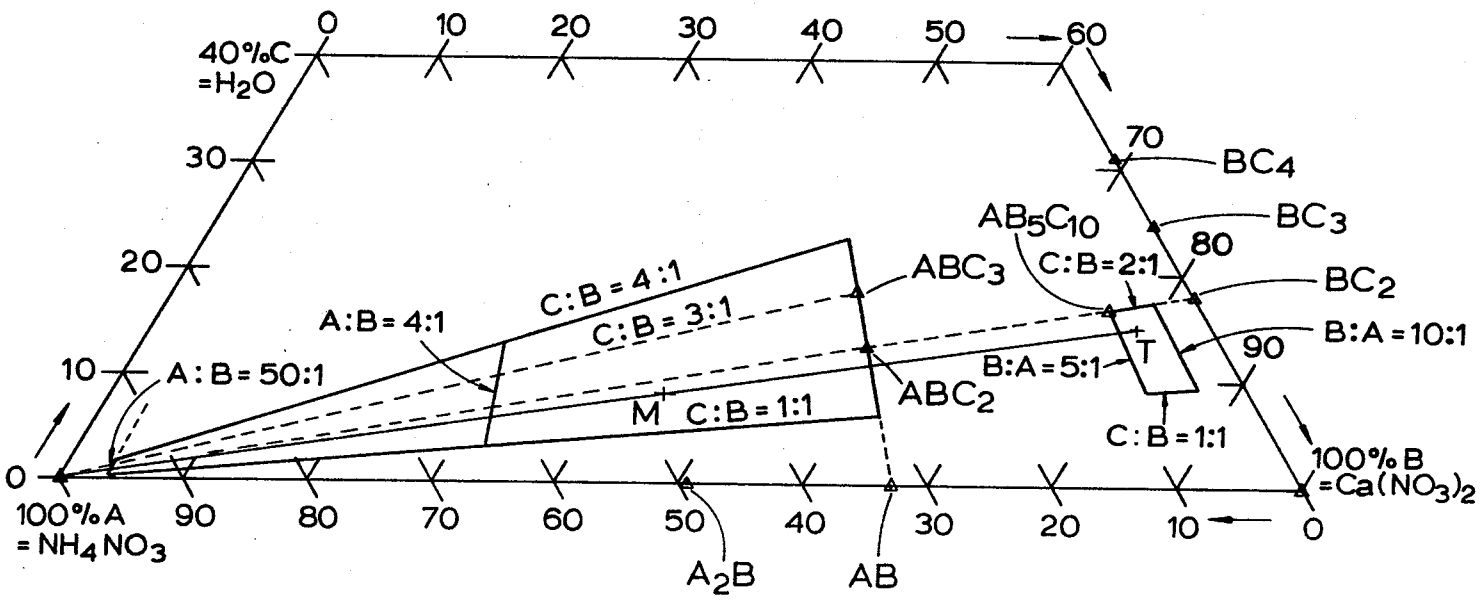
FIG. 6 is a diagram depicting composition limitations for raw materials intermediates and salts in the explosive.

It is assumed that the increase in sensitivity observed in explosives prepared according to the present invention, is closely related to the unique properties of the system AN/CN/water. The properties of importance for the present invention are depicted in Diagrams 1 through 5. From the diagrams the scope of the invention will be clearly understood, as will the limits for alternatives to the examples given below. What can be learned from the diagrams provides more or less an explanation of the findings which constitute the present invention, but the experimental findings could of course in no way be foreseen from what is inherent in these diagrams. However, whether the explanations given below are right or wrong, or in any way incomplete, shall in no way influence the validity or the present application, nor the patent rights eventually arising therefrom.

DESCRIPTION OF THE PREFERRED EMBODIMENTS

The diagrams, whose linear coordinates are in percentages by weight, comprise any mixture of AN and CN between 0 to 100 percent, and of water between 0 to 40 percent. Anhydrous AN and CN are represented by the lower left and right corner, and the markings A and B, respectively, whereas water is represented by the top, not shown, of the complete triangle and the marking C.

In this system, in addition to the anhydrous pure substances, are found in total 8 different crystalline compounds, some anhydrous and some containing water of crystallization. Among them are 5 double salts of AN and CN, two anhydrous and three with water of crystallization. All of these crystalline entities are indicated in their proper places in the diagrams by small triangles, and their respective compositions are expressed by the abbreviations A, B and C for their components.

Different temperature intervals and different areas of composition of the liquid with which the compounds can be in equilibrium, are properly related to each of the compounds. In addition to these different crystalline entities, AN itself is known to exist in several crystalline modifications, among which one is stable below 32° C and commonly known as Form IV, and another is stable between 32° C and 84° C and commonly known as Form III. No hydrated form of AN is known, but of CN there are three crystalline species, with 2, 3 or 4 water molecules of crystallization. The former two have very small areas of existence, and they are of no importance to the presence invention.

Of the 5 double salts of AN and CN, two are anhydrous and found on the base line of the diagrams, whereas the other three have their distinct number of bound water molecules.

Of particular importance is the fact that two of these compounds are metastable, viz. $ABC_2$ and $A_2B$, whereas $AB_5C_{10}$ is stable under certain conditions and metastable under others.

In general, if conditions for a metastable compound to exist is brought about, very often this compound does form, with a corresponding liquid phase in equilibrium with it. However, the composition may then at any time spontaneously change to the stable condition with the formation of a different solid compound and a different (if any) liquid in equilibrium with it. Once the stable form is realized, the metastable form will not reappear.

At 20° C, as shown in Diagram 1, the compounds A, $ABC_3$ and $BC_4$ are stable and will exist in equilibrium with solutions of compositions given by the arcs ax, xz, and zb, respectively. In addition, the compounds $ABC_2$ and $AB_5C_{10}$ are then metastable in contact with solutions represented by the arcs $x'y'$ and $y'z'$, respectively, whereas the liquidus lines for A and $BC_4$ then are extended from $x$ to X' and $z$ to $z'$, respectively.

From this diagram it may now be read that any composition below the lines $A/x/AB_3/z/BC_4$ will be composed of solid components only, provided that the compound $AB_3$ is realized. If this is not the case, compositions within the sectors $Axx'$ $ABC_2x'y'$, $AB_5C_{10}y'z'$ and $BC_4z'z$ will be composed of a solid represented by the sector's apex and a liquid represented by the sector's arc. This is to say that any composition below the line $A/BC_2$ in any case will be a solid matter, and that compositions within the triangle $A/ABC_2/ABC_3$ will be so too, provided $ABC_3$ is realized. What crystalline species a composition within these areas is made up of, is however not determined by these conditions of state, that depends on how the composition is brought about.

By way of example, a composition represented by the point T may be thought of as composed of mainly the entities $BC_2$ and AB, and as composed of mainly $AB_5C_{10}$ and B as well. Actually composition T may represent a commercial grade of CN of particular interest for the present invention, and, due to its mode of manufacture, it may be assumed to consist mainly of $AB_5C_{10}$.

Now, any mixture of this material and pure, anhydrous AN will be represented by the line connecting A and T. Because no liquid phase will form spontaneously, the mixture will retain for a considerable period of time its property of being a dry mixture of the two solid ingredients A and T.

By way of example, a mixture of A and T represented by the point M is now chosen to follow what happens during a heat treatment like the one essential to the present invention.

At 30° C the liquidus lines of the system are moved somewhat towards the base line of the diagram, as depicted in Diagram 2. The compound $AB_5C_{10}$ has got a liquidus line of its own, viz., yz, and has attained a true stability. Still the line AT is entirely in an area of only solid species, and consequently nothing will happen to the mixture M. In the temperature interval between 35° C and 40° C the system will change in a principal manner, because the compound $ABC_3$ can no longer be a stable component thereof. Instead, the anhydrous AB may come into existence. At 40° C, as indicated in Diagram 3, the compound AB will then be in equilibrium with solutions of compositions corresponding to the arc *xy*. If AB now really does form from some of the ingredient particles, some bound water of crystallization will be set free to form a liquid of composition *x*. Thus, the mixture M has started to change from being a blend of solid particles to be a damp mixture of liquid *x* and solids of formal compostion S, i.e. a mixture of AB and A.

The change may, however, take a considerable period of time to be completed, and will be difficult to start. Thus, even at 40° C and somewhat above, the mixture M may still have the property of being a mixture of A and T. The convension, however, may be initiated, either by seeding the mixture with crystals of AB, or by the introduction of a small quantity of water.

In the temperature interval between 45° C and 50° C another change will in principle occur in the system, so far as the compound $ABC_2$ will no longer have any stability, whereas the anhydrous compound $A_2B$ may attain a metastable existence.

The situation at 50° C is determined by Diagram 4, which indicates that, if AB has not formed, the mixture M will be converted to the compound $A_2B$ together with a liquid of composition 1'. If now the compound AB starts to form, the composition will further convert towards consisting of solids s, (most probably a mixture of AB and $A_2B$) in equilibrium with liquid x.

Above 50° C there will be no further fundamental changes in the system of importance to the present invention, but the liquidus lines will steadily move further towards the more anhydrous areas of the diagrams. Thus, at 70° C the situation will be as depicted in Diagram 5, from which it will be seen that the mixture M is either converted to the stable compound AB and the liquid 1, or to the metastable compound $A_2B$ and the liquid 1'.It is also seen that in the metastable case the liquidus line is in general nearer to the total composition point M than it is in case the stable solid is formed. That is to say that relatively more liquid is formed when the metastable compound comes into existence, than when the stable does.

At 80° C the mixture M is practically converted in total to a liquid provided the stable AB is not formed, if so, the mixture has become a liquid with some solid matters suspended in it.

Much the same as now described will happen to any mixture with a composition within the triangle $A/ABC_3/AB$ of Diagram 1. If A predominates in the mixture, the liquid phases formed above 35° C or 50° C will most often be of the invariance compositions *x'* or *x*, instead of the liquidus points 1' and 1 which occured for the mixture M.

When a heated mixture of composition within the triangle $A/ABC_3/AB$ is again cooled, the amount of liquid phase will again diminish. If then at 45° C or lower the metastable $ABC_3$ is formed, the total mixture will eventually become a mixture of solids. If the $ABC_2$ does not form, the $ABC_3$ will sooner or later form when the temperature is brought below 35° C. This will also cause the mixture to solidify completely.

What is to be noticed is that if the mixture originally comprised crystal entities from the far right part of the diagram, i.e. $AB_5C_{10}$ or the AN-free species, these compounds will never again appear after the heat treatment.

Of great importance is also that in the mixture of AN and one or more of the double salts $A_2B$, AB, $ABC_2$ and $ABC_3$ supercooling is a frequent phenomenon. That is to say that a conversion of one of the entities into another, with simultaneous altering of the liquid phases in equilibrium with them, may take considerable time. Thus, even far below 35° C, where liquid phases should cease to exist, the material may be damp or cloggy, indicating that recrystallizations and phase transitions have not come to a completion. In addition to the phase transitions between the double salts mentioned, the conversion of AN III to AN IV at 32° C will also have to take place, probably facilitated by a liquid phase being present.

The present invention relies on the observation that mixtures of AN and CN, heated to at least 35° C and preferably to 50° C to bring about a conversion into the double salts here mentioned, and subsequently cooled under sustained mechanical agitation and with some kind of liquid fuel added prior to or during the final cooling period, constitute a kind of explosive mixtures capable of being initiated by means of a blasting cap, and capable of propagating the detonation even in diameters down to 17 mm.

It is assumed that this high sensitivity to initiation and the stable propagation of the detonation are caused by recrystallizations and solid phase transitions occuring in the nitrate system during cooling, in the way that the liquid fuel is extremely finely distributed over the multitude of newly formed crystal surfaces, and that the capillary forces between these crystal surfaces greatly facilitates the distribution of the fuel.

It is possible to produce explosive mixtures having a chemical composition practically identical to that of the present invention, but with a dissimilar physical appearance, quite simply without performing the cooling under sustained mechanical agitation. The damp or partly molten nitrate mixture may be mixed with a fuel and poured or pumped into boreholes or preformed cartridges, where it is allowed to cool and solidify. What is then produced is a more or less rigid matter, the sensitivity of which is considerably less than the particulate matter produced according to the present invention. Thus, it is also concluded that the sensitivity is dependent on the physical form in which the mixture appears.

Of importance to produce an explosive suited for practical purposes we have found that the ratio between AN and CN shall not be too low. If a particulate explosive mixture is prepared in which the mole ratio mentioned is between 1 to 1 and 4 and 1, that is in the middle part of the diagrams, two unfavourable effects are experienced. Primarily the energy release by the detonation will be decreased, due to the unfavourable heat of decomposition of the CN compared to that of the AN. And secondly, the mixture will have a great tendency to harden, which makes difficult the inserting of a blasting cap into cartridges made thereof as well as the tamping of the explosive in boreholes. This hardening may be due to the supercooling mentioned above, that is to say that some recrystallization phenomena may be present even days or weeks after the production. An additional explanation may be found in the fact that the nitrate mixtures of comparatively low AN-content are rather hygroscopic, and that absorbed water may cause further recrystallization and crystal growth.

Thus, in a particulate explosive mixture according to the present invention the mole ratio of AN to CN should be equal to, or higher than 4 to 1. The other limit is set by the vanishing effect of ever decreasing additions of CN to AN. A mole ratio of AN to CN of 50 to 1 seems to be a practical limit. Simultaneously there are limits for the water content in the mixture, and it is found that the mole ratio of water to CN shall not exceed 4 to 1, and preferably not exceed 3 to 1, to avoid a damp consistency and hardening phenomena, and it shall not go below 1 to 1, to make possible the formation of sufficient liquid phase for the recrystallizations, to proceed. The limits here stated is depicted in Diagram 6.

Thus, one preferred embodiment of the invention is to proceed according to what is stated above, i.e. heating a mixture of AN and CN within said limits to at least 35° C, and preferably to at least 50° C, then cooling the mixture under sustained mechanical agitation to below 35° C and preferably further to 25° C, under which cooling period a fuel is added which is at least partly liquid at 35° C.

It is, however, also a feature of the invention to disclose some particular embodiments which may be of preference in certain circumstances.

The heating of an amount of nitrates to 50° C or more and thereupon cooling it again may take considerable time. A more preferred embodiment of the invention is what may be called the two-step-process. According to this, a mixture of AN and CN having mole ratios within the limits of 4 to 1 and 1 to 1, and water in a mole ratio to CN within the limits of 4 to 1, preferably 3 to 1, and 1 to 1, i.e. compositions in the middle part of Diagram 6, is heated to at least 50° C to produce a liquid, with or without crystalline particles suspended therein. In this way the dissolution of the CN starting material is caused. Then an additional amount of anhydrous, unheated AN is added, which changes the composition to lie within the limits stated earlier, and at the same time lowers the temperature of the mixture to nearly the specified value. Preferably, the heating procedure may in this case take place in one particular apparatus equipped with heating surfaces, whereafter the liquid is transferred to another piece of equipment in which the additional AN and the fuel is added and the cooling is completed.

Further, another embodiment of the invention is which the need of heat transfer to the nitrate mixture is reduced or avoided, is to make use of the heat content in the fuel and of the heat generated by the mechanical work applied by the mixing equipment. Particularly, when nitrobodies are used as a fuel, their content in the final mixture may be 10 percent by weight or higher, and they can easily be preheated to 50° C or even more. The mechanical work of a mixer agitating the nitrate components will often rise the temperature by some 5 degrees centigrades or more during a mixing cycle. These two heat sources may in concert heat the material to above the 35° C level, thus completely eliminating the need of external heat supply.

When, however, the temperature is not rised very much above the 35° C level, as particularly may be the case just mentioned, the sensitivity obtained will be less than what could be reached by a higher temperature treatment. In general cap sensitivity is always obtained, but the critical diameter will most often be of a value that permits the use in boreholes of 2 inches or more in diameter only.

It is, however, also a feature of the invention to increase further the effect of such a limited heat treatment. The increase in effect, or a decrease in the critical diamter, is provided by introducing during the heating period a small quantity of water in addition to what is bound as water of crystallization in the ingredients.

Such an additional quantity of water obviously facilitates the conversion of the starting materials to the double salts mentioned above, by dissolving the nitrate particles superficially. The amount of water thus added shall of course not bring the total water content above the limits previously set forth, and it is found to be of advantage when the amount lies between 0.5 and 2.5 percent by weight of the entire explosive mixture, and preferably between 1.0 and 1.5 percent.

It will be appreciated that the present invention may be performed in process equipment of different design. One embodiment of particular interest may, however, be to carry out the process steps in a continuous manner. The equipment will in this case, as will be obvious to those skilled in the art, take a form with a heating zone, during the passage of which the nitrates are mixed and heated, and a subsequent cooling zone into which the fuel and optionally additional quantities of AN are introduced. This continuous mode of operation is particularly important in order to minimize the quantity of explosive matter under treatment, and it lends itself advantageously to remote control and automated operation for the sake of safety.

Regarding nitrate components to be used in connection with the present invention, practically no limits exist as to their composition and physical form, provided a mixture thereof may be formulated to lie within the limits stated above. As mentioned, a commercial grade CN having a certain content of AN is to be preferred, mainly due to its being a free-flowing, prilled or particulate solid which easily can be handled. The composition of such a preferred material can be specified by a mole ratio of CN to AN between the limits of 5 to 1 and 10 to 1 and a mole ratio of water to CN within the limits of 2 and 1 and 1 to 1. This specification is represented by a four-sided area in the right part of Diagram 6, and it is seen that it includes the composition called T above, and has the entity $AB_5C_{10}$ as one of its corners.

Both the AN and the CN, advantageously, may be subject to a moderate size reduction, but no high comminution is necessary.

As mentioned above, the increased sensitivity effected by the treatment here described, is thought to be due to a liquid fuel being finely distributed over a multitude of newly formed crystal surfaces. Actually, liquid fuels of different kinds may be used as the oxygen consuming components with nearly the same result. The fuel may or may not solidify below the temperature at which it is mixed with the nitrates. The only condition for a fuel to be of effect when used in connection with the present invention is therefore that it is at least partly liquid at the temperature 35° C. As will be seen from the examples given below, a petroleum fraction commonly known as No. 2 fuel oil may advantageously be used.

Other examples mention the use of nitrated aromatic hydrocarbons, particularly those which, due to their being a mixture of different chemical compounds, have a low melting point or rather a broad interval of solidification.

In addition to such a liquid or partly liquid fuel, further oxygen consuming components may of course be present in the particulate explosive composition, in order to modify quality parameters other than the sensitivity, as it is mentioned in the examples given below.

The examples include, for the sake of comparison, compositions prepared under circumstances outside the scope of the present invention, as indicated in the appropriate places.

EXAMPLE 1

Ammonium nitrate of a fertilizer grade quality, was moderately ground so that approximately 80 percent thereof passed a No. 30 sieve (Sieve opening 0.59 mm) and approximately 85 percent of it was retained on a No. 200 sieve (Sieve opening 0.074 mm).

Commercial calcium nitrate, also a fertilizer grade quality, of the following approximate composition, was ground to have practically the same particle size as the ammonium nitrate:

| | |
|---|---|
| Calcium nitrate | : 79.0 per cent by weight |
| Ammonium nitrate | : 6.0 per cent by weight |
| Water of crystallisation | : 15.0 per cent by weight |

From these nitrates and commercial No. 2 fuel oil three different samples of explosive composition were prepared. Out of these, two were prepared for the sake of comparison only, whereas the third was prepared according to the present invention.

SAMPLE 1 A

Components were:

| | |
|---|---|
| AN | : 94.4 per cent by weight |
| Fuel oil | : 5.6 per cent by weight |

The composition represents a plain ANFO substantially oxygen balanced. The components were mixed thoroughly at 20° to 25° C. The sample was transferred to a thin-walled rigid plastic tubing for tests on initiability and detonative propagation. Observations were:

In 32 mm diameter: Failure for a 32 g TNT primer.

SAMPLE 1 B

Components were:

| | |
|---|---|
| AN | : 78.5 per cent by weight |
| CN | : 15.0 per cent by weight |
| Fuel oil | : 6.5 per cent by weight |

This composition is also practically oxygen balanced, as the higher content of available oxygen in the CN compensates for the higher fuel oil content in the composition. The mole ratio of AN to CN was approx. 14.7 to 1. The components were thoroughly mixed at 20° to 25° C. The sample was then transferred to a plastic tubing as was Sample 1 *a*. Observations were the same:

In 32 mm diameter: Failure for a 32 g TNT primer.

SAMPLE 1 C

Components were the same as in Sample 1 *b*. They were mixed under heating to 50° C, whereby the sample changed appearance into a damp, adherent mass, to which the fuel oil was added. During the subsequent cooling to 25° C the material turned into a dry, free-flowing particulate matter whose particle size was coarser than that of the starting materials. After transfer to plastic tubing the following observation was made:

In 32 mm diameter: Detonation for a blasting cap no. 8.

This example shows that the heat treatment according to the invention converts a composition not capable to propagate a detonation in 32 mm diameter, into a cap sensitive explosive composition having a critical diameter below 32 mm.

EXAMPLE 2

The nitrates used were the same as in Example 1. As the predominant fuel was used dinitrotoluene (DNT), which shows, as produced, a melting interval between 30° C and 54° C. In Example 2 *a*, this dinitrotoluene was modified by the removal of some of its predominant 2.4-dinitrotoluene content, so that the remainder was entirely liquid at 35° C. In addition to the DNT was used as the fuel a fine-grain paraffin wax, to increase water resistance, and "atomized" aluminum, to increase the energy release during detonation. Both of the samples had the composition:

| | |
|---|---|
| AN | : 69.2 per cent by weight |
| CN | : 15.0 per cent by weight |
| DNT | : 12.8 per cent by weight |
| Paraffin | : 1.0 per cent by weight |
| Aluminum | : 2.0 per cent by weight |
| Total | 100.0 |

The mole ratio of AN to CN was approx. 12.2 to 1.

Both samples were treated in a mixing apparatus, the mechanical agitation of which caused a temperature rise of 5° to 8° C during a period of 15 minutes.

SAMPLE 2 A (referred for the sake of comparison only) The initial temperature of the nitrates was 23° C, that of the DNT was 35° C. The mixing time was 15 minutes, during which the paraffin wax and the aluminum were also added. The final temperature of the composition was 30° C. Observations after transfer of the composition into plastic tubings were:

| | |
|---|---|
| In 32 mm diameter | : Detonation for blasting cap no. 8<br>Failure for blasting cap no. 6 |
| In 22 mm diameter | : Failure for blasting cap no. 8 |

SAMPLE 2 B

The initial temperature of the nitrates was 23° C, that of the DNT was (after preheating) approx. 70° C. The mixing time was 15 minutes, during which the paraffin wax and the aluminum was added. The final temperature of the composition was 38° to 39° C. Observations were, after transfer of the composition into plastic tubing:

| | |
|---|---|
| In 22 mm diameter | : Detonation for blasting cap no. 6<br>Failure for blasting cap no. 4 |

This example shows that between 30° C and 40° C there is a change in the effect of the heat treatment so that both the critical diameter and the minimum initiating charge of the composition is considerably decreased.

EXAMPLE 3

The nitrates used were the same as in the previous examples, as were also the paraffin wax and the aluminum. As the predominant fuel was used a mixture of trinitrotoluene, enriched in unsymmetrical isomers, and of dinitrotoluene, in a weight ratio of 35 to 65, which mixture was liquid down to approx. 30° C. Three different samples were prepared having the same composition, viz.:

| | | |
|---|---|---|
| AN | : | 67.8 per cent by weight |
| CN | : | 15.0 per cent by weight |
| DNT/TNt | : | 14.2 per cent by weight |
| Paraffin | : | 1.0 per cent by weight |
| Aluminum | : | 2.0 per cent by weight |
| Total | | 100.0 |

The mole ratio of AN to CN was approx. 11.6 to 1.

SAMPLE 3 A

The initial temperature of the nitrates was approx. 20° C . The nitrotoluenes and the paraffin were heated to approx. 70° C before the mixing procedure. The final temperature of the composition was approx. 35° C. Observations were:

| | | |
|---|---|---|
| In 25 mm diameter | : | Detonation for blasting cap no. 4 |
| In 22 mm diameter | : | Failure for blasting cap no. 8 |

SAMPLE 3 B

The nitrates were heated to approx. 50° C whereby a damp mass was produced. This was subsequently cooled under sustained agitation until the temperature was brought below 25° C, whereafter the fuels were added, the nitrotoluenes and the paraffin being in a molten state of approx. 70° C. Observations were:

| | | |
|---|---|---|
| In 17 mm diameter | : | Detonation for blasting cap no. 8 |
| | | Failure for blasting cap no. 4 |

EXAMPLE 3 C

The nitrates were heated to approx. 50° C, the fuels added (nitrotoluenes and paraffin of temperature 70° C) and the cooling subsequently performed. Observations were:

In 17 mm diameter: Detonation for blasting cap no. 4

This example shows that a heat treatment of the nitrates to 50° C induces in the composition a higher sensitivity than does a treatment limited to 35° C, and further that much of the sensitivity increase may be obtained by adding the fuels during the final cooling period.

EXAMPLE 4

A composition equal to that of Example 2 was prepared in a manner called the two-step-process above. The procedure was as follows:

15.0 parts of CN and 16.5 parts of AN were heated to 50° C, producing a nearly molten crystal suspension, in which the mole ratio of AN to CN was approx. 3 to 1. To this mixture were added the fuels, of which DNT and paraffin were preheated to 60° C. Thereafter, 52.7 parts of unheated AN were added, which caused the temperature of the composition to drop to 33° C. Further cooling under sustained agitation brought the temperature down to 20° C before transfer of the composition into plastic tubings. Observations were:

| | | |
|---|---|---|
| In 22 mm diameter | : | Detonation for blasting cap no. 4 |
| In 17 mm diameter | : | Failure for blasting cap no. 8 |

This example shows that the two-step-process induces a higher sensitivity in the composition than does the procedure of Example 2 a, (temperature limited to 30° C) and that the same critical diameter and an even lower minimum initiating charge is obtainable than in Example 2 b.

EXAMPLE 5

This example comprises, for the sake of comparison, a composition which is not converted to a particulate matter according to the invention, but which is rather a so called "melt explosive" or a slurry. The predominant fuel was a mixture of TNT and DNT similar to that used in Example 3. In addition, a quantity of guar gum was included in the formulation in order to make it more like a slurry. Additional free water was also added, to assure fluidity at 60° C. The composition was:

| | | |
|---|---|---|
| AN | : | 66.0 per cent by weight |
| CN | : | 14.6 per cent by weight |
| DNT/TNT | : | 12.0 per cent by weight |
| Paraffin | : | 1.0 per cent by weight |
| Aluminum | : | 3.0 per cent by weight |
| Guar gum | : | 1.0 per cent by weight |
| Free water | : | 2.4 per cent by weight |
| | | 100.0 |

SAMPLE 5 A

The nitrate components were heated to 60° C, at which temperature the other components were added and thoroughly mixed with the partly molten nitrates. The composition was transferred by pouring into plastic tubing and allowed to cool without agitation. The product was a rather dense, nearly solid material. Observations were:

In 67 mm diameter: Failure for 160 g TNT primer.

SAMPLE 5 B

After the addition of the fuels to the nitrates at 60° C, the composition was cooled under agitation, which produced a free-flowing particulate matter according to the invention. After transfer to plastic tubing, observations were:

In 32 mm diameter: Detonation for blasting cap no. 4.

This example shows that the conversion by cooling under agitation to a particulate matter is essential for the sensitivity to be developed.

EXAMPLE 6

Three samples were prepared having the same composition, viz.:

| | | |
|---|---|---|
| AN | : | 79.3 per cent by weight |
| CN | : | 5.0 per cent by weight |
| DNT/TNT | : | 10.7 per cent by weight |
| Paraffin | : | 1.0 per cent by weight |
| Aluminum | : | 3.0 per cent by weight |
| Guar gum | : | 1.0 per cent by weight |
| Total | | 100.0 |

SAMPLE 6 A

The nitrate components were heated to 60° C, at which temperature the other components were added and thoroughly mixed. After cooling under agitation and transfer to plastic tubing of the particulate matter produced, observations were:

| | |
|---|---|
| In 22 mm diameter | : Detonation for blasting cap no. 4 |
| In 17 mm diameter | : Failure for blasting cap no. 8 |

SAMPLE 6 B

The nitrate components were heated to approx. 30° C, at which temperature the preheated nitrotoluenes and the other fuels were added. Final temperature of the mixture was 37° C, whereafter cooling under agitation was performed. Observations on the composition in plastic tubing were:

| | |
|---|---|
| In 32 mm diameter | : Detonation for blasting cap no. 4 |
| In 25 mm diameter | : Failure for blasting cap no. 8 |

SAMPLE 6 C

The preparation was performed as with Sample 6 b at 37° C, but before cooling was started, an amount of water equalling 1 percent of the total weight was introduced and thoroughly distributed throughout the mass. Observation on the final particulate matter were:

In 22 mm diameter: Detonation for blasting cap no. 4

This example shows that an addition of a small amount of water during a treatment limited in temperature to below 40° C practically equalizes in effect a treatment where the temperature is raised to 60° C.

EXAMPLE 7

A series of compositions were prepared in which the ratio of AN to CN were varied over a considerable interval. The predominant fuel was DNT as mentioned in example 2, the heating of the nitrates was made to 50° C, at which temperature the fuels were added. The compositions and observations were:

| Sample no. | 7 a | 7 b | 7 c | 7 d |
|---|---|---|---|---|
| AN | 80.7% | 75.0% | 69.2% | 63.5% |
| CN | 5.0% | 10.0% | 15.0% | 20.0% |
| DNT | 11.3% | 12.0% | 12.8% | 13.5% |
| Paraffin | 1.0% | 1.0% | 1.0% | 1.0% |
| Aluminum | 2.0% | 2.0% | 2.0% | 2.0% |
| Total | 100.0% | 100.0% | 100.0% | 100.0% |
| Mole ratio AN/CN | 43 | 20 | 12 | 8 |
| In 22 mm diam, blasting cap No. 4 | Det.[x)] | Det. | Det. | Det. |
| In 17 mm diam, blasting cap No. 8 | Failure | Failure | Det. | Det. |

[x)]Det. = detonates

We claim:

1. In the preparation of a particulate explosive composition comprising as oxygen releasing components ammonium nitrate and calcium nitrate in a molar ratio within the limits of 50 to 1 and 4 to 1, having a water content in molar ratio to calcium nitrate within the limits of 4 to 1 and 1 to 1, and comprising at least one oxygen consuming component which is substantially insoluble in water and completely or partly liquid at temperatures above 35° C, the improvement according to which ammonium nitrate and calcium nitrate with the said water content are heated to temperatures between 35° C and 80° C, whereafter the nitrate mixture is cooled under sustained mechanical agitation to below 35° C to produce a free-flowing particulate matter, during which heat treatment the oxygen consuming component(s) is (are) added, prior to or during the final cooling period.

2. In the preparation of a particulate explosive composition according to claim 1 the process consisting in the heating of ammonium nitrate and calcium nitrate in a molar ratio within the limits of 4 to 1 and 1 to 1 to a temperature of at least 50° C to produce a liquid, with or without crystalline particles suspended in it.

3. In the preparation of a particulate explosive composition according to claim 1, the process consisting in heating the mixture of ammonium nitrate and calcium nitrate by means of the heat content in the oxygen consuming components preheated to at least 50° C, and by means of the heat generated by the mechanical work applied by the mixing equipment.

4. In the preparation of a particulate explosive composition according to claim 1, the addition of a quantity of water, within the limits of 0.5 to 2.5 percent of weight of the explosive mixture, to the mixture of ammonium nitrate and calcium nitrate during the heating period.

5. In the preparation of a particulate explosive composition according to claim 1, the process of continuously feeding the nitrate components into an equipment where said components are continuously mixed and heated, and where said components in successive zones are cooled and simultaneously mixed with the oxygen consuming components of the explosive mixtures.

6. In the preparation of a particulate explosive composition according to claim 1, the use of a commercial grade of calcium nitrate having a content of ammonium nitrate in a molar ratio to calcium nitrate within the limits of 1 to 5 and 1 to 10 and a water content in a molar ratio to calcium nitrate within the limits of 2 to 1 and 1 to 1.

7. In the preparation of a particulate explosive composition according to claim 1, the use as an oxygen consuming component of a liquid hydrocarbon fuel, preferably a commercial fuel oil.

8. In the preparation of a particulate explosive composition according to claim 1, the use as an oxygen consuming component of a mixture of nitrated aromatic hydrocarbons, which completely or partly is liquid at temperatures above 35° C.

9. A particulate explosive composition prepared according to claim 1.

10. In the preparation of a particulate explosive composition according to claim 1, wherein the molar ratio of water to calcium nitrate is between 3 to 1 and 1 to 1.

11. In the preparation of a particulate explosive composition according to claim 1, wherein the ammonium nitrate, calcium nitrate and water are heated to temperatures of at least 50° C.

12. In the preparation of a particulate explosive composition according to claim 1, wherein the nitrate mixture is cooled under sustained mechanical agitation to below 25° C.

13. In the preparation of a particulate explosive composition according to claim 2, wherein the nitrate liquid mixture thus-produced is thereafter mixed, in another piece of equipment, with additional quantities of anhydrous and unheated ammonium nitrate and the oxygen consuming components, and cooled under sustained mechanical agitation to below 35° C.

14. In the preparation of a particulate explosive composition according to claim 4, wherein the water is added to the mixture of ammonium nitrate and calcium nitrate when the temperature of the mixture is between 30° C and 40° C.

15. In the preparation of a particulate explosive composition according to claim 10, wherein the nitrated aromatic hydrocarbon mixture is a mixture of nitrotoluenes.

* * * * *